United States Patent [19]

Sato et al.

[11] Patent Number: 4,700,497

[45] Date of Patent: Oct. 20, 1987

[54] AUTOMATIC DOCUMENT PAGE TURNING APPARATUS

[75] Inventors: Susumu Sato, Ninomiya; Toshio Arashida, Chigasaki, both of Japan

[73] Assignee: NCR Corporation, Dayton, Ohio

[21] Appl. No.: 905,096

[22] Filed: Sep. 8, 1986

[30] Foreign Application Priority Data

Dec. 20, 1985 [JP] Japan ..... 60-285901

[51] Int. Cl.[4] ..... G09F 19/00

[52] U.S. Cl. ..... 40/531; 40/475; 40/530

[58] Field of Search ..... 40/531, 475, 380; 84/487

[56] References Cited

U.S. PATENT DOCUMENTS 4,280,036 7/1981 Fubatsu ..... 235/379
4,488,367 12/1984 Yamauchi et al. ..... 40/531
4,516,866 5/1985 Yamauchi et al. ..... 40/531
4,545,141 10/1985 Ito et al. ..... 40/475
4,663,873 5/1987 Shinbrot ..... 40/475

FOREIGN PATENT DOCUMENTS 60-79998 5/1985 Japan .

*Primary Examiner*—Gene Mancene
*Assistant Examiner*—Wenceslao J. Contreras
*Attorney, Agent, or Firm*—Wilbert Hawk, Jr.; Albert L. Sessler, Jr.; George J. Muckenthaler

[57] ABSTRACT

An automatic page turning apparatus for use with a passbook or like document wherein drive rollers advance the passbook to a page turning station, pressing means moves the passbook into position for a page turning roller to engage with and to turn up the page to a bowed condition. Page turning detecting means is coupled to sequence control means and to retry control means for ensuring that the page is turned to the partially turned position for subsequent turning of the page.

18 Claims, 17 Drawing Figures

PAGE TURNING DETECTING MEANS
RETRY CONTROLLING MEANS
PRESSING PAD DRIVING MEANS
PAGE TURNING ROLLER DRIVING MEANS
FEED ROLLER DRIVING MEANS
PINCH ROLLER DRIVING MEANS
PASSBOOK LOCATION DETECTING MEANS
SEQUENCE CONTROLLING MEANS

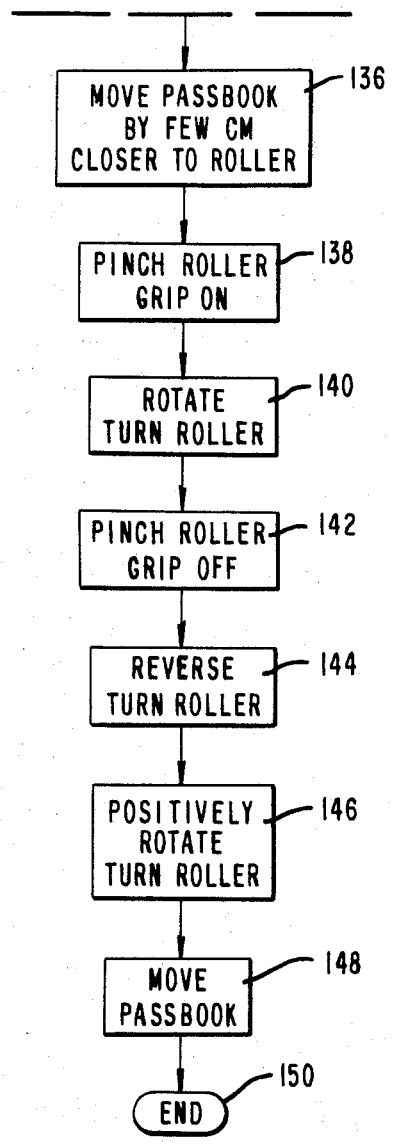
FIG. 5B
FIG. 6
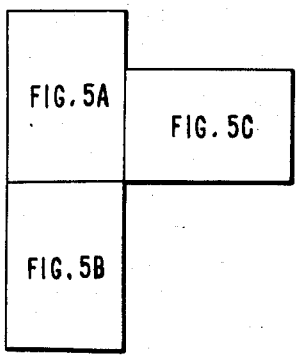

AUTOMATIC DOCUMENT PAGE TURNING APPARATUS

BACKGROUND OF THE INVENTION

In recent years, there has been a trend to automate banking functions as they relate to bank customers. An example of this trend is the Automatic Teller Machines (ATM's) which provide remote banking functions without the presence of a bank teller. One of these functions is the automatic issuance of passbooks and other types of multiple sheet or page documents. In issuing a passbook, data pertaining to the name of the owner, his account number, etc. is required to be printed on the cover of the passbook and on subsequent pages of the passbook. Mechanisms have been developed for automatically opening the cover and turning the pages of the passbook before printing is performed on the pages. The automatic page turning function makes it possible to automatically turn the pages of a passbook which is inserted into the banking mechanism or apparatus in the closed state or is stacked in the apparatus in the closed state until the desired page is located and appears for printing operation.

Representative documentation in the field of page turning mechanism includes Japanese Laid Open Patent Specification No. 79998/85 wherein a page turning roller is rotated while pressing a passbook against the roller by means of a pressing pad. When the page is partially turned up to a predetermined height, the pressing pad is lowered or driven downward so that pages other than the page desired to be turned are not brought into contact with the page turning roller. The partially turned up page is substantially maintained in the partially turned up state by reason that one end of the page is pressed against the page turning roller by the resilience of the page against its bend. In this partially turned up state, the page turning roller is further rotated to lift up the page onto the roller. The passbook is then moved or transported so as to pass under the roller to accomplish the page turning operation.

U.S. Pat. No. 4,280,036, issued to K. Fukatsu on July 21, 1981, discloses bank passbook printing apparatus in which friction rollers are pressed against the passbook when in an open position while clamp means rigidly holds the passbook in a position spaced from the roller, and retaining pins penetrate the uppermost leaf of the open passbook, which is partially lifted by the rotation of the friction rollers.

U.S. Pat. No. 4,545,141, issued to M. Ito et al. on Oct. 8, 1985, discloses an automatic document page turning apparatus that holds one edge of a passbook at a station located along a guide chute and includes a drive member movable in a direction perpendicular to the guide chute for engaging and moving the passbook cover into a partially open position and control means to move the cover to a fully open position.

It has been found in prior construction that, due to the thickness and stiffness of the cover of the passbook, the cover cannot be turned and the passbook has to be inserted into the printing apparatus in an open condition by the clerk. This limitation, of course, prevents such a mechanism from being used in ATM's.

SUMMARY OF THE INVENTION

The present invention relates to document printing apparatus and more particularly to an apparatus for automatically opening a passbook cover and turning subsequent pages of the passbook for printing data thereon.

In order to carry out and to practice the present invention, there is disclosed a mechanism for turning over the cover and the inner pages of a passbook or other type of multiple-page document, which document includes a guide chute along which a closed passbook is transmitted to a page turning station, and a page turning roller positioned adjacent the guide chute at the page turning station. The page turning roller is adapted to be rotated in a page-turning direction, and a drive member is mounted adjacent the guide chute opposite the page turning roller which drive member is movable in a direction normal or perpendicular to the guide chute to engage and move the passbook into a bowed condition or configuration in which the top page or cover of the passbook is engaged by the page turning roller.

The apparatus also includes page turning detecting means to detect that the page to be turned is turned up a predetermined amount by the page turning roller, document transfer means, and sequence control means for controlling each of the above several operating means to operate in a predetermined order for turning a page of the document. After the page has been partially turned up by the predetermined amount, the sequence controlling means controls the document transfer means to move the document a further predetermined amount or distance closer to the page turning roller to cause the page to be curved up or bent further for turning thereof.

The sequence controlling means also includes retry controlling means to control each of said several operating means so as to re-execute the page turning operation in case of failure to turn the page the first time. The re-executing operation includes causing the document transfer means to move the document in a manner such that the distance between the bound portion of the passbook and the page turning roller is shortened or reduced and then the sequence means controls each of the several operating means to perform the page turning operation.

The retry controlling means controls the page turning roller so as to increase the page turning amount beyond the predetermined amount upon the re-executing of the page turning operation. The retry controlling means controls the document transfer means and the page turning roller so as to change the moved amount of the document or the page turning amount each and every time the page turning operation is re-executed on the page.

The present invention provides apparatus or mechanism that is so constructed that, in case the page cannot be turned up to a predetermined height, the passbook is moved closer to the page turning roller and the page turning operation is re-executed. If in such case the partially turned up state or condition of the page cannot be maintained, the page is turned up an amount more than the normal amount and the drive member is then released. The movement of the passbook closer to the page turning roller provides for greater or increased contact of such roller with the page and reduces or eliminates slippage action in the page turning operation.

In view of the above discussion, a principal object of the present invention is to provide automatic page turning apparatus or mechanism for use with a multiple-page document.

Another object of the present invention is to provide apparatus for turning over or opening the cover of a passbook when such passbook cover is in the closed position.

An additional object of the present invention is to provide apparatus which is capable of turning the cover or the page members of a passbook, which members may be of various thicknesses.

A further object of the present invention is to provide an automatic page turning apparatus which can turn over a page of a passbook of reduced resilience.

Still another object of the present invention is to provide apparatus which can turn over a page of a passbook of reduced flexural rigidity or resilience due to previous usage of or due to prior printing on such page.

Still a further object of the present invention is to provide automatic page turning apparatus or mechanism which can turn over a page of a passbook which is curled or curved due to prior usage or other reasons.

Additional advantages and features of the present invention will become apparent and fully understood from a reading of the following description taken together with the annexed drawing.

BRIEF DESCRIPTION OF THE DRAWING

FIGS. 5A–5C taken together constitute flow charts illustrating the page turning operation under the control of the sequence controlling means and the retry controlling means; and FIG. 6 illustrates the arrangement of FIGS. 5A–5C.

DESCRIPTION OF THE PREFERRED EMBODIMENT

Figure 1:
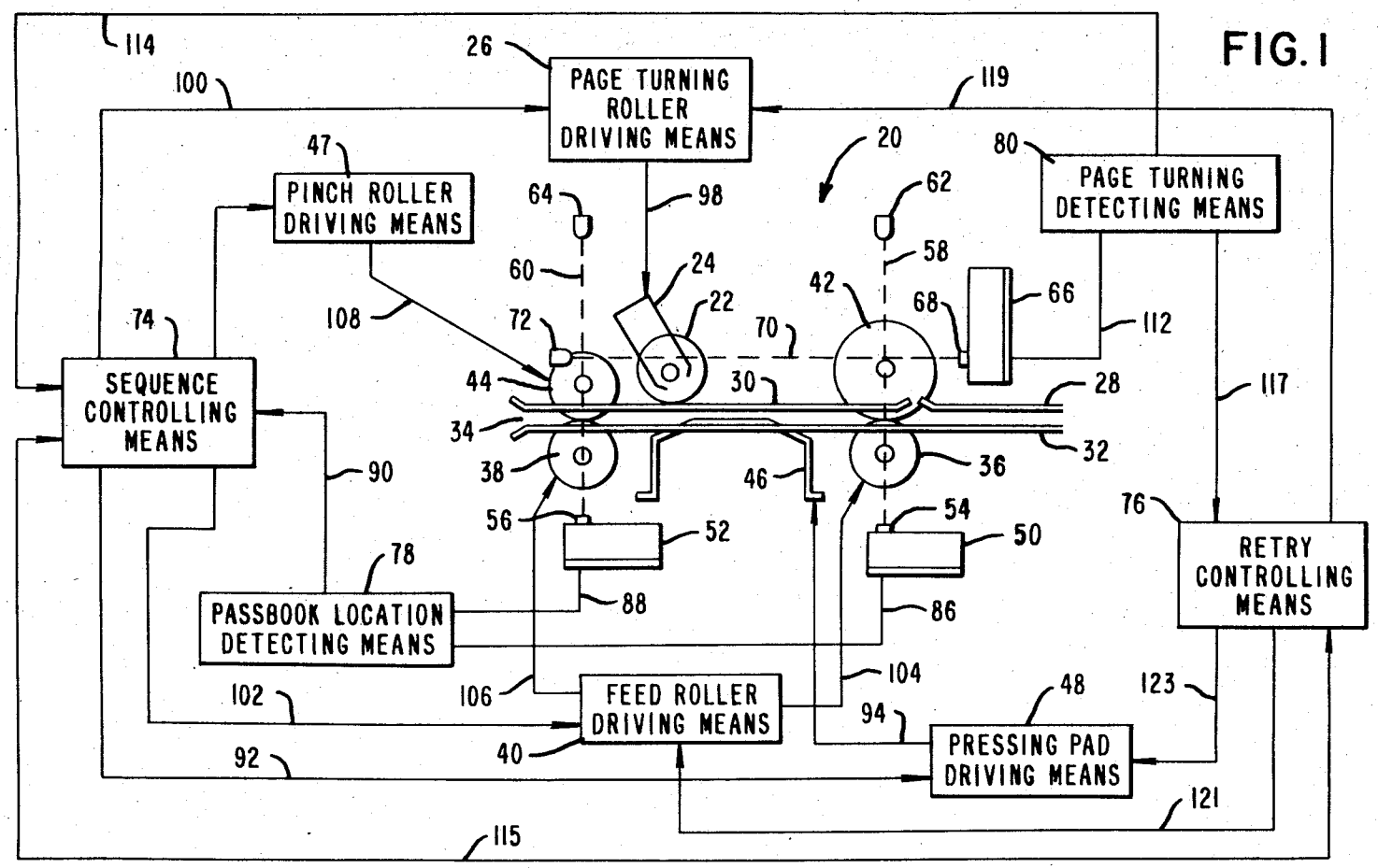
FIG. 1 is a side elevational view in diagrammatic form of page turning apparatus or mechanism showing a preferred embodiment of the structure of the present invention.

Referring now to FIG. 1, there is disclosed a side elevational view of the page turning apparatus of the present invention which is indicated generally by the numeral 20 and which includes a page turning roller 22 rotatably mounted on a support member 24 in which the roller 22 is operated by conventional drive means in the manner of a stepping motor or the like and represented by page turning roller driving means 26. The roller 22 is mounted adjacent a plurality of guide plate members 28, 30 and 32 which form a guide path in the form of a chute or passageway 34. Mounted adjacent the guide chute 34 are a plurality of rubber, drive feed rollers 36, 38 operated by conventional motor-driven means represented by feed roller driving means 40 in which each of the drive rollers 36, 38 coacts with an associated pressure roller 42, 44 in a manner that is well-known in the art to move a closed passbook along the guide chute 34. The pressure or pinch rollers 42, 44 are driven by pinch roller driving means 47 in a manner wherein the pinch rollers are moved vertically or toward and away from the drive rollers 36, 38.

Located adjacent the guide plate member 32 and opposite the page turning roller 22 is a U-shaped pressing pad or drive plate member 46 which is moved vertically by pressing pad driving means 48. As will be described more fully hereinafter, energizing of the driving means 48, which may be in the form of a solenoid or the like, results in the upward movement of the drive plate member 46.

A pair of sensors 50, 52 are positioned under the respective feed rollers 36, 38 and have sensing devices 54, 56 vertically aligned with the axis of such feed rollers. The sensing devices 54, 56 are responsive to and sense light beams 58, 60 from respective light sources 62, 64 positioned above the guide member 30. A sensor 66 is positioned adjacent the pinch roller 42 and above the guide member 28 and includes a sensing device 68 responsive to and sensing a light beam 70 originating from a light source 72 adjacent the pinch roller 44.

The sensing and interruption of the several light beams 58, 60 and 70 effects the sending of ON signals to a sequence controlling means 74 and to a retry controlling means 76 by way of a passbook location detecting means 78 and a page turning detecting means 80. The sequence controlling means 74 and the retry controlling means 76 include a microcomputer along with ROM, RAM and various associated interface devices, and such controlling means control the operation of the several driving or operating means in a predetermined order or program which is stored in the ROM and effected or carried out by means of the microcomputer in accordance with a page turning instruction signal and also in accordance with signals from the passbook location detecting means 78 and the page turning detecting means 80.

Referring now to FIGS. 2A–2F, inclusive, there are shown side views of the several operating parts of the page turning mechanism during a usual or ordinary page turning operation. As shown in FIGS. 2A–2F, a closed passbook member 82 with its bound edge portion 84 oriented in the forward direction is driven by the feed rollers 36, 38 in a left-to-right direction. The passbook member 82 is sensed by the pair of sensing devices or photodetectors 54, 56 (FIG. 1) which cooperate with light sources 62, 64 in a manner that is well-known in the art to sense the leading and trailing edges of the passbook member 82. Signals generated by the photodetectors 54, 56 are transmitted to the passbook location detecting means 78, which detects whether the passbook member 82 is in an open or closed condition by measuring the time interval between the operation of the photodetectors 56 and 54. As alluded to above, the control mechanism comprises a microprocessor and firmware therefor which control various portions of the page turning mechanism in a predetermined order in response to receiving control signals transmitted from the photodetectors 54, 56. As will be described more fully hereinafter, detecting the closed or open position of the passbook relative to the opposing force exerted by the cover or a page member will control the amount of pressure that the drive plate member 46 will exert on the passbook 82 upon movement of the drive plate member into engagement with the passbook member.

Figure 2A:
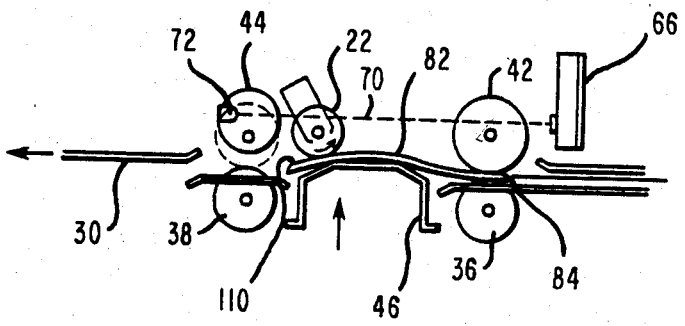
FIGS. 2A–2F illustrate side elevational views in diagrammatic form of the usual page turning operation.

The passbook 82 is driven in a left-to-right direction along the guide chute 34 by the drive rollers 38, 36 to the page turning position. In response to the signals generated by the photodetectors 54, 56, a reversible drive motor (not shown) operatively connected to the guide plate member 30 (FIG. 1) by any conventional means, such as a rack and pinion or like shutter mechanism, will slide the guide plate member 30 to the left as shown in FIG. 2A thereby removing the guide plate member from a blocking position with respect to the drive plate member 46. After the guide plate member 30 has been moved to an actuated or left position (FIG. 2A), the sequence controlling means 74, in response to signals from sensors 50 and 52 over lines 86 and 88 (FIG. 1) to the passbook location detecting means 78 and over line 90 to the sequence controlling means 74, will output control signals over line 92 to the pressing pad driving means 48 which outputs an energizing signal. The operation of the driving means 48 results in a signal over the line 94 and subsequent movement of the drive plate member 46 in an upward direction engaging the passbook member 82. The passbook member 82 at this point has its bound end portion 84 engaged and held by the drive roller 36 and the pressure roller 42 (FIG. 2A). Movement of the drive plate member 46 in an upward direction moves the passbook member 82 into a curved or bowed configuration (FIG. 2B) allowing the cover or top page member 96 to be engaged by the page turning roller 22. At this point in time, the roller 22 is being rotated in a counterclockwise direction (FIG. 2A) by the driving means 26 (FIG. 1) over line 98 and in response to a signal over line 100 from sequence controlling means 74. A line 102 connects the sequence controlling means 74 with the feed roller driving means 40 and lines 104 and 106 connect such feed roller driving means 40 to the feed rollers 36, 38.

A line 108 connects the pinch roller driving means 47 with the pinch roller 44 for moving such roller upwardly after the guide plate member 30 is moved to the left (FIG. 2A) to provide a clear path between the roller 22 and the drive member 46. When the passbook 82 is in the page turning position, as illustrated in FIG. 2A, the passbook is held in place by the rollers 36 and 42 and the drive member 46 presses the passbook into contact with the roller 22. The drive member 46 is formed or constructed in a manner, upon pressing upwardly against the passbook 82, to cause the passbook to be curved or bowed in a configuration wherein the left or free edge 110 (FIG. 2B) of the cover or top page member 96 is drawn back from the edges of the lower pages resulting in an uneven edge portion of the passbook, permitting an arrangement which is effective for the page turning operation.

Figure 2B:
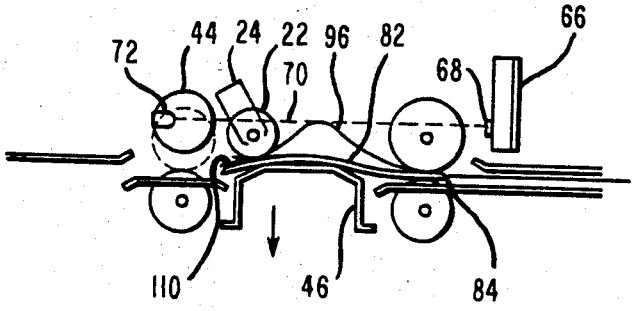

Rotation of the page turning roller 22 in a counterclockwise direction results in the cover or top page member 96 being moved to a partially turned up position or rotated to a raised curved position, as shown in FIG. 2B, which intercepts the light beam 70 outputted from the light source 72 (FIGS. 1 and 2B) and which is normally detected by the photodetector or sensing device 68 of sensor 66. The interception of the light beam 70 by the cover member or top page member 96 results in the photodetector member 68 being turned on and outputting a signal over line 112 to the page turning detecting means 80. A signal is transmitted over line 114 from the detecting means 80 to the sequence controlling means 74. The controlling means 74 in response to receiving the signal from the detecting means 80 will output a control signal over line 92 to the pressing pad driving means 48 which moves the drive plate member 46 in a downward direction (FIG. 2B). The roller member 22 continues rotating in a counterclockwise direction for a predetermined time period which raises the cover or top page member 96 to a partially-open position adjacent the roller support member 24 (FIG. 2B). After the predetermined time period has elapsed, the sequence controlling means 74 will output appropriate control signals to the page turning roller driving means 26 (FIG. 1) over line 100 which disables the driving means and stops the rotation of the page turning roller member 22.

The sequence controlling means 74 will also output control signals over line 102 to the feed roller driving means 40 (FIG. 1) for rotating the feed rollers 36, 38 (FIG. 2C) in a counterclockwise direction. This counterclockwise rotation of the feed rollers 36, 38 results in the leftward movement of the passbook member 82 by a distance "d", as viewed in FIG. 2C, resulting in the stationary page turning roller 22 rotating the partially opened cover member 96 to a completely open position (FIG. 2D).

It is seen that under certain conditions, as illustrated in FIG. 2B, the cover or top page member 96 is lifted or raised to the position wherein such member interrupts the beam 70 of light from the source 72. However, the cover or top page member 96 may be of insufficient flexural rigidity or it may be extremely flexible due to the nature of the paper or like medium or due to previous or long time usage, such that it is impossible for the roller 22 to turn the page by reason of slippage therewith or of insufficient frictional contact between the surfaces of the two members.

Figure 2C:
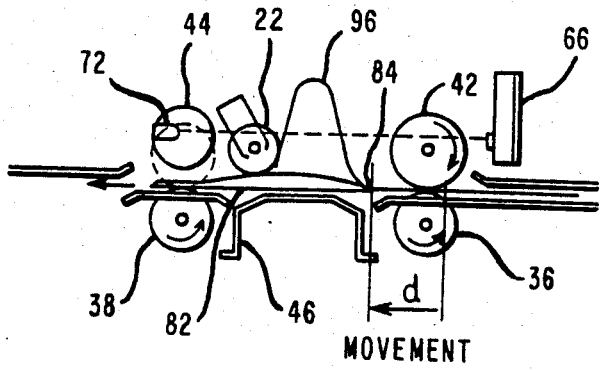

The moving of the passbook 82 through the distance "d", as shown in FIG. 2C, places such passbook closer to the roller 22 to enable better contact between the surfaces of the two members and tends to prevent idle running of the roller 22.

Figure 2D:
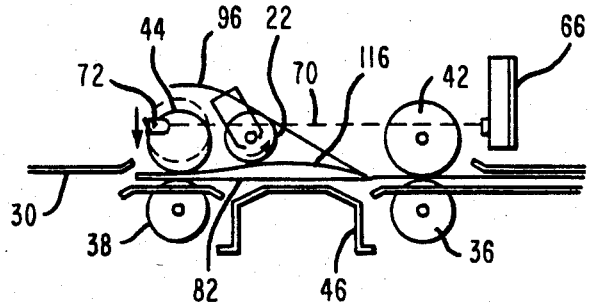
Figure 2E:
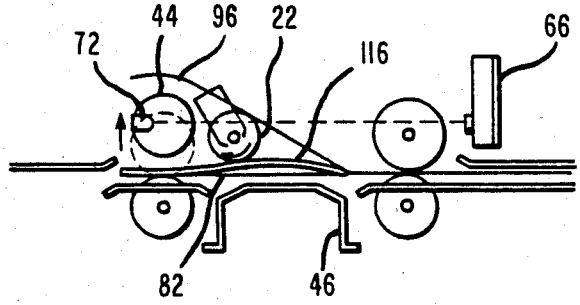

After the passbook 82 is caused to be curved or bowed upwardly by the pressing pad 46 and the page 96 is lifted or raised in a page turning operation by counterclockwise rotation of the roller 22 from the position of FIG. 2C to the position of FIG. 2D, a swelling or curvature, as at 116 (FIG. 2D), may result from the pressing pad action and from the movement of the passbook 82 the distance "d" in the leftward direction. This swelling or curvature 116 can be smoothed out by rotation of the page turning roller 22 in a clockwise direction, as shown in FIG. 2E, where it is also noted that the pinch roller 44 has been raised or elevated to allow the passbook 82 to freely move in the leftward direction.

Figure 2F:
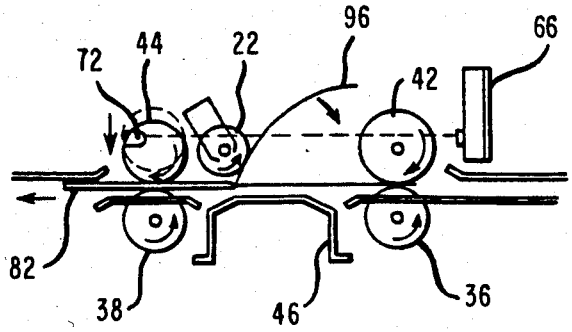

After the page turning roller 22 has been rotated in the clockwise direction for a predetermined period of time to smooth out the swelling or curvature 116, the pinch roller 44 is again moved downward to contact with and hold the passbook 82 against the drive roller 38 for moving the passbook leftward, as shown in FIG. 2F. It is seen that the page turning roller 22 is again rotating counterclockwise against the page 96 to complete the page turning operation. Then the passbook 82 is advanced in the leftward direction toward printing mechanism (not shown) where printing is accomplished on the open page 96.

In the series of steps as just described and as illustrated in FIGS. 2A–2F, it is seen that a preferred page 96 of a passbook 82 has sufficient resilience or flexural rigidity to respond to the operating elements of the page turning operation without undue amount of waiting or without slippage of the roller 22. However, in the case wherein a page of a passbook 82 has been previously folded or a page 96 which is deformed or has lost or reduced its natural flexural rigidity due to long time usage, the page turning roller 22 may idle against the page without any effect in turning the page, even when the passbook 82 is moved the distance "d", or the page may even be so flimsy as to fall downwardly with the pressing pad 46 upon lowering thereof.

Figure 3A:
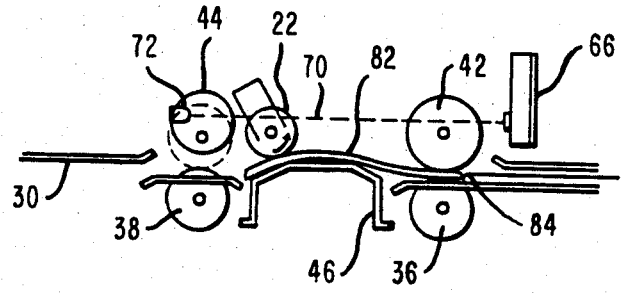
FIGS. 3A–3C represent side elevational views of a first retrying operation.
Figure 3B:
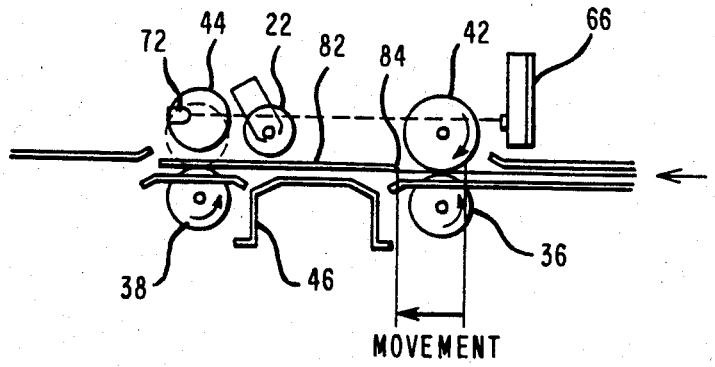
Figure 3C:
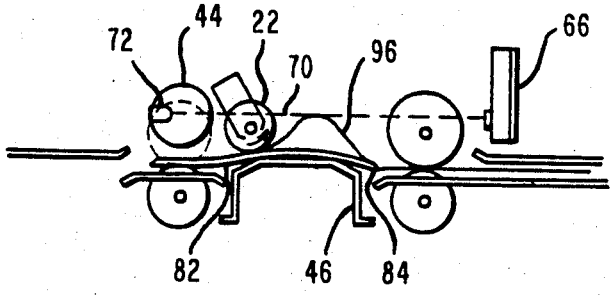

The present invention provides that the page turning operation is capable of accommodating pages of different form, texture, or condition so as to efficiently perform the operation for different and various passbooks. FIGS. 3A–3C illustrate a first retrying operation in re-executing one or more steps of the page turning operation. The first retrying operation is performed in the case where it is impossible to turn up the page 96 because the page turning roller 22 is idling or is slipping relative to the surface of the page, as shown in FIG. 3A. A cause of the condition (FIG. 3A) may be due to reduced resilience of the passbook 82 against the bending or curving initiated by the pressing pad 46 with the result that the passbook is not in sufficient contact with the roller 22.

It has been found that a shorter distance between the bound end portion 84 and the page turning roller 82 provides a greater resisting force (resilience) against bending of the passbook 82. Accordingly, when a situation occurs as is illustrated in FIG. 3A, the passbook 82 is moved closer to the roller 22, as shown in FIG. 3B, to increase the resisting force of the passbook 82 against bending, and then the page turning operation is re-executed. The passbook moving step (FIG. 3B) and the re-executing step (FIG. 3C) are performed to shorten the distance between the bound end portion 84 of the passbook and the roller 22 in step by step manner until the page turning operation is successfully completed.

Figure 4A:
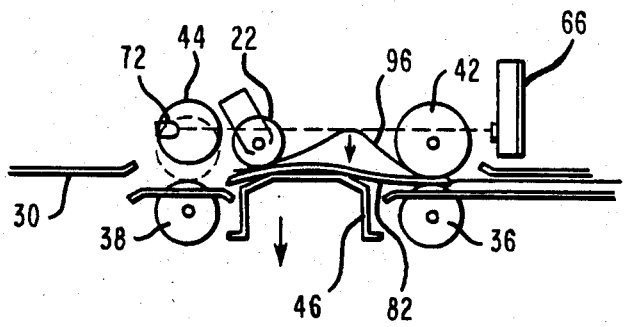
FIGS. 4A–4C are similar views of a second retrying operation.
Figure 4B:
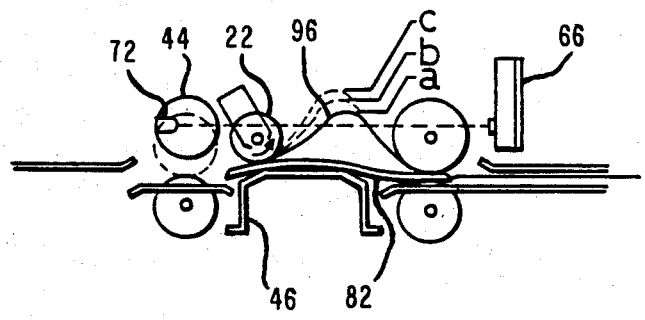
Figure 4C:
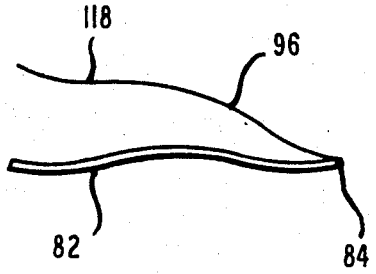

FIGS. 4A–4C illustrate a second retrying operation wherein the page turning operation is re-executed in the case wherein the page 96 cannot be kept or maintained in a partially turned up position. Such a situation (FIG. 4A) occurs as the result of a condition, as shown in FIG. 4C, wherein the page 96 has a deformation 118 which prevents a resilient force by the roller 22 from acting on the page 96 in a generally horizontal direction. In other words, the roller 22 is in contact with a curved or curled portion, as at 118, of the page 96 and cannot effectively turn up the page to the desired page turning position. The second retrying operation is illustrated in FIG. 4B wherein the turning amount of the page 96 is increased to bend the page in a manner that provides for a tighter engagement or contact with the page turning roller 22 and the point of contact is changed to nearer the edge of the page from the curled portion 118. In this arrangement, the page turning amount is stepwise increased to positions a, b, and c (FIG. 4B) until the page can be turned up and maintained in its turned up state. In case the page 96 cannot be maintained in its partially turned up state, even at position c and after the passbook 82 is moved closer to the roller 22, as executed by the first retrying operation of FIGS. 3A–3C, the first retrying operation is again performed until the deformed page 96 can be maintained in its partially turned up state so as to complete the page turning operation.

Next, the sequence controlling means 74 and the retry controlling means 76 will be described. The sequence controlling means 74 is coupled with the retry controlling means 76 by means of path 115 and includes a microcomputer, ROM, RAM and various interfaces. The microcomputer controls the entire page turning operation in accordance with predetermined procedures stored in the ROM. An embodiment of the controlling procedures for the microcomputer stored in the ROM will be described with reference to the accompanying FIGS. 1, 2, 5A, 5B and 5C. As seen in FIG. 1, a line 117 couples the page turning detecting means 80 and the retry controlling means 76, and a line 119 connects the retry controlling means and the page turning roller driving means 26. Lines 121 and 123 connect the retry controlling means with the feed roller driving means 40 and with the pressing pad driving means 48, respectively.

Figure 5A:
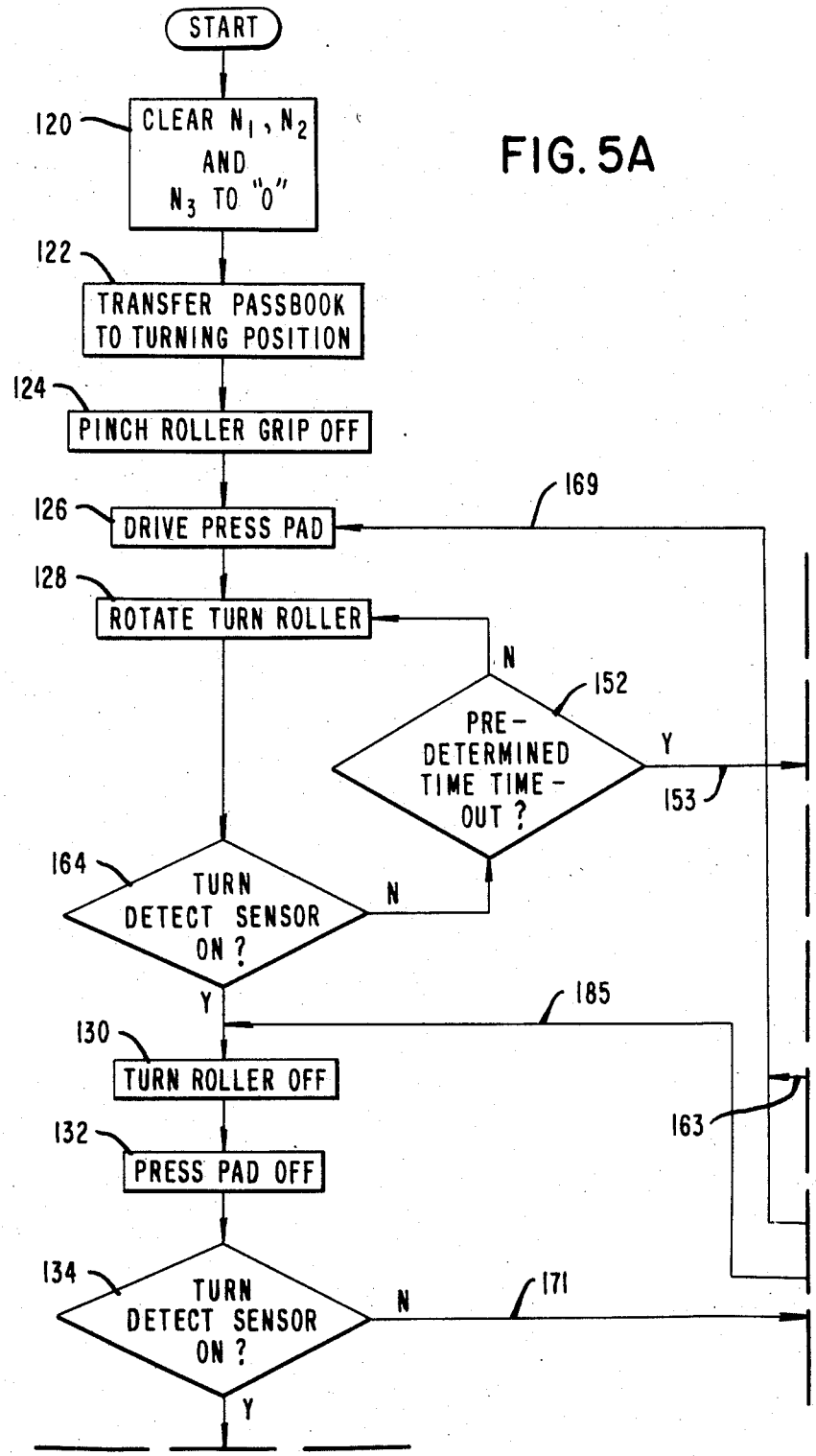
Figure 5C:
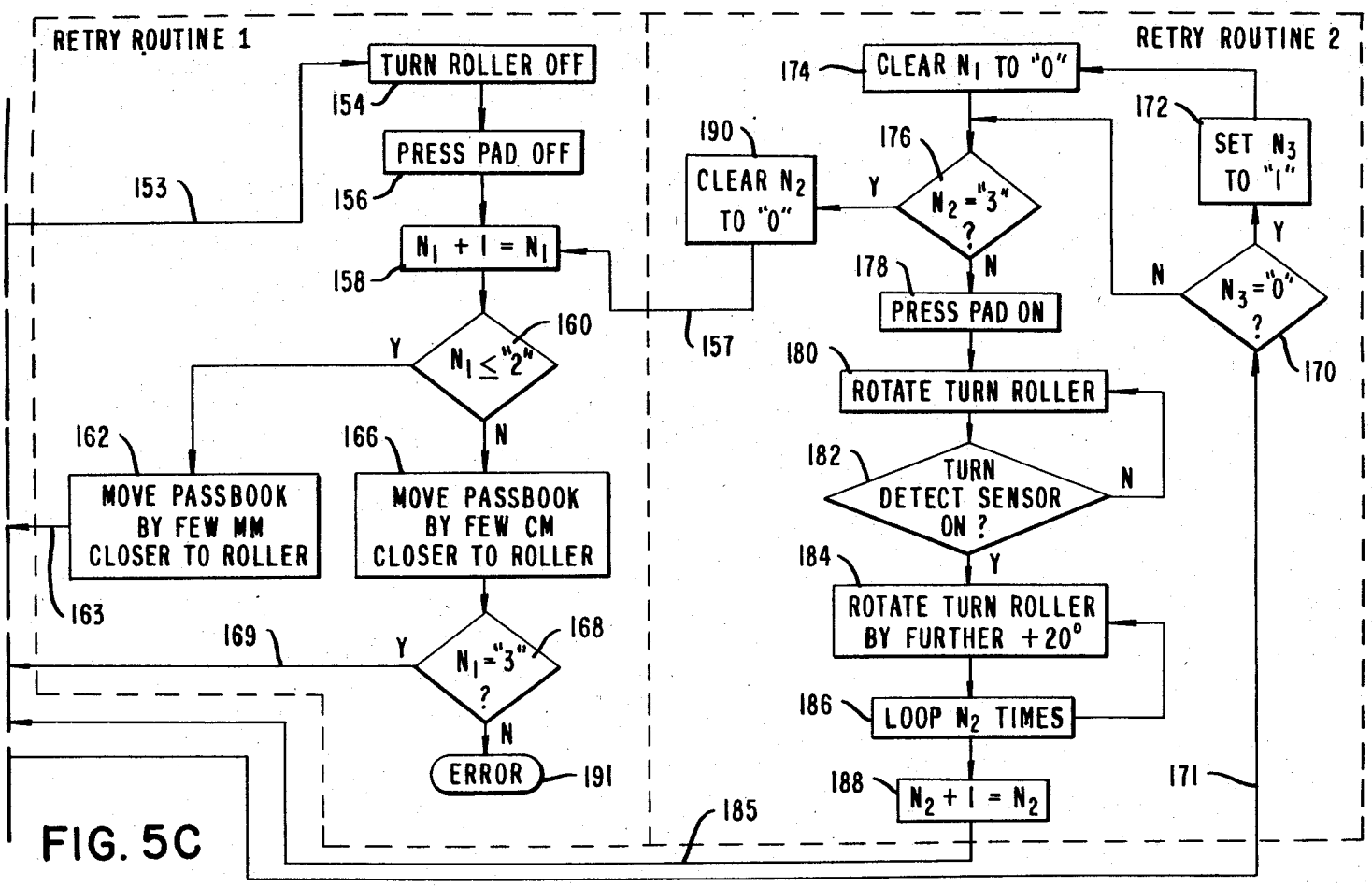

Referring to FIG. 5A and upon the receipt of a page turning instruction signal, the sequence controlling means 74 clears counters $N_1$, $N_2$ and $N_3$ (block 120) which counters are used in a retry routine 1 or retry routine 2. Then, the feed roller driving means 40 (FIG. 1) is controlled by the sequence controlling means 74 over line 102 to rotate the feed rollers 36, 38 counterclockwise to feed the passbook 82 to a page turning position (block 122). When the feed of the passbook 82 to the page turning position is confirmed by a signal over line 90 from the passbook location detecting means 78 to the sequence controlling means 74, the pinch roller 44 is moved upward (gripped off) and the guide shutter 30 is moved to the left, as seen in FIG. 2A (block 124). After the pressing pad 46 is driven upwardly by the pressing pad driving means 48 to press the passbook 82 against the page turning roller 22, the page turning roller is rotated counterclockwise to gradually turn up the page 96 (blocks 126 and 128). When the page turning detecting sensor 66 is turned on (as detected in block 164) during the gradual turning up of the page 96 by reason of the page intercepting the light beam 70 from the light source 72, the rotation of the page turning roller 22 is stopped (block 130) and the pressing pad 46 is moved downward (block 132). Then, in block 134, the condition is checked to see whether the page turning detecting sensor 66 is kept on or not, that is, whether the page 96 is maintained in the partially turned up state or not. The turned on state of the sensor 66 causes the passbook 82 to be moved by several centimeters closer to the page turning roller 22 under the ON condition of the sensor, as indicated in block 136 (FIG. 5B). After the pinch roller 44 is moved downward to grip the passbook 82, the page turning roller 22 is rotated counterclockwise to lift the page 96 on the page turning roller 22 (blocks 138 and 140). Next, the pinch roller 44 is raised or gripped off and the page turning roller 22 is rotated clockwise (reversely rotated) to smooth out the swelling or curvature 116 of the passbook 82 (blocks 142 & 144). Then, the passbook 82 is moved to the left, as viewed in FIG. 1, while rotating the page turning roller 22 counterclockwise (normal rotation) to complete the page turning operation (blocks 146, 148 and 150).

Next, the first retrying operation controlling procedures will be described with reference to FIGS. 3A, 3B, 3C, 5A and 5C.

In the case wherein the page turning roller 22 is idling, as shown in FIG. 3A, due to the reduced flexural rigidity of the passbook 82, and wherein the page 96 cannot be partially turned up, and since the page turning detecting sensor 66 is not turned on even after a predetermined period of time, the control is changed in block 152 (FIG. 5A) to allow entry by way of path 153 to the retry routine 1. In the retry routine 1 (FIG. 5C), the rotation of the page turning roller 22 is stopped and the pressing pad 46 is moved downward for the preparation of the retrying operation (blocks 154 and 156). Next, "1" is added to the counter $N_1$ for the retry routine 1 (block 158). Since the counter $N_1$ is cleared to "0" in block 120, $N_1$ is set to "1". Hence, as a result of the comparison in block 160, the flow is turned from block 160 to block 162 to move the passbook 82 closer to the page turning roller 22 by a distance of a few millimeters. Then, the flow is returned to block 126 over paths 163 and 169 to retry the turning over of the page 96 (blocks 126, 128, 164 and 152).

In the case wherein the page still cannot be partially turned up to the predetermined height, the retry routine 1 is re-entered to further move the passbook 82 by a few millimeters closer to the page turning roller 22 in the same manner as that in the first retry (blocks 154, 156, 158, 160 and 162). In block 158, $N_1$ is increased to "2" and the process continues to block 162. In case the page partially turning up step is still inadequate, the retry routine 1 is re-entered in block 152 from block 164. Then, $N_1$ is increased to "3" in block 158, so that the flow is shifted from block 160 to block 166 to move the passbook 82 a distance of a few centimeters closer to the page turning roller 22. Then, the flow is returned from block 168 to block 126 by way of path 169 to retry the page partially turning up operation. In case the page partially turning up operation is still impossible, the retry routine 1 is re-entered in block 152. Then, $N_1$ is increased to "4" in block 158 so that the flow extends again through block 166 and is directed through block 168 to an Error condition, as shown in block 191.

Next, the controlling procedures of the retry routine 2 will be described with reference to FIGS. 4A, 4B, 4C, 5A and 5C.

In normal operation the page 96 should be kept in its partially turned up state even if the pressing pad 46 is turned off in block 132 (FIG. 5A). However, when the passbook 82 is deformed or curved, as shown at 118 in FIG. 4C, the resilient force (flexural rigidity) of the passbook against the bend is not horizontally applied to the page turning roller 22, so that the page 96 tends to fall down, as shown in FIG. 4A. In this case, the page turning detecting sensor 66 is turned off, so that the control process enters the retry routine 2 by way of path 171 following the check in block 134 (FIG. 5A). In the retry routine 2 (FIG. 5C), the condition is checked in block 170 to see whether or not $N_3$ is "0". $N_3$ is a counter indicating whether or not the retry routine 2 has ever been entered. $N_3$ is set to "1" in block 172 even if the retry routine 2 is entered only one time during a page turning operation, and is held in this state until the page turning operation is completed. Since $N_3$ is cleared to "0" in block 120 (FIG. 5A), the routine is advanced over path 171 and through block 170 to block 172 in which $N_3$ is set to "1" and then advanced to block 174 in which $N_1$ is cleared to "0". The reason for clearing $N_1$ to "0" in block 174 is that there exists the possibility that the control process or procedure is entered in the retry routine 1 due to the condition caused by reduced resilience of the passbook 82 against the bending or curving initiated by the pressing pad 46. The condition of the passbook 82 is checked by checking the step of block 152 before entrance is made to the retry routine 2 for correcting the condition caused by a deformation, as at 118, in the page 96. Then, in block 176, the condition is checked to see whether or not the retry counter $N_2$ for the retry routine 2 is set to "3". However, since $N_2$ was cleared to zero at block 120 and kept in such state, the flow is advanced to blocks 178 and 180 (FIG. 5C) to perform driving of the pressing pad 46 and then rotating the page turning roller 22. When the page turning detecting sensor 66 is turned on, the flow goes from block 182 to block 184 in which the page turning roller 22 is further rotated by 20 degrees. Then in block 186, block 184 will be looped $N_2$ times. However at the present time $N_2$="0" so that no loop is performed and the flow is advanced to block 188 in which "1" is added to $N_2$, so that $N_2$="1". Then, the flow is returned by way of path 185 to blocks 130, 132 and 134 (FIG. 5A) in which the condition is checked again to see whether or not the page 96 can be kept in its partially turned up state. In the case wherein the page 96 cannot be kept in its partially turned up state even after the above mentioned re-executing operation, the retry routine 2 is again entered, in which case $N_3$="1", so that the flow is advanced from block 170 to block 176 in which case the same operation is performed as that in the previous occasion. However, since $N_2$="1" (one loop), in block 186, the process of block 184 is performed two times and hence the page turning roller 22 is rotated by 40 degrees in excess of the usual case. In the case wherein the page 96 still cannot be kept in its partially turned up state, the same operation is repeated while counting up $N_2$.

In the case wherein $N_2$="3" at the checking in block 176 (FIG. 5C) of the retry routine 2, the flow is advanced to block 190 in which $N_2$ is cleared to "0", and then the retry routine 1 is entered by way of path 157. In the retry routine 1, the same operations are performed as those previously described for the retry operation 1 (FIGS. 3A–3C). However, since the page partially turning up operation has been successfully performed once, it is rarely necessary to enter the retry routine 1 again by the checking in block 152 and the flow is usually advanced to block 134 (FIG. 5A). However, in case the page 96 still cannot be kept in its partially turned up state, the flow re-enters the retry routine 2 in which case the retry operation is performed three times while changing the page turning amount. Further, in case the page 96 still further cannot be kept in its partially turned up state in view of the above mentioned retrying operations, the control operation is re-entered in the retry routine 1 to further move the passbook 82. Moreover, in case the page 96 cannot be kept in its partially turned up state, the retrying operation 2 is performed three separate times for each time the passbook 82 is moved in the retry routine 1. If the page 96 still cannot be kept in its partially turned up state even after the passbook 82 is moved three times, the counter $N_1$ is set to "4" in the block 158 (FIG. 5C) at the 4th entrance of the retry routine 1, so that it is judged ERROR in block 168 in the retry routine, and the process proceeds to block 191. Although, in the above mentioned embodiment, the retrying operations is changed in each case or condition and re-executed three times in each of the retrying operations 1 and 2, it is apparent that the present invention may be constructed such that the retrying operation is changed in every two retrying operations, and that the number of times of retrying operations may be increased or decreased. Further, in place of or in addition to the above mentioned retrying operations, the rotating speed of the page turning roller 22 can be changed.

The present invention is constructed such that the passbook can be moved closer to the page turning roller 22 after the page 96 has been partially turned up, and contact pressure between the page 96 and the page turning roller 22 is increased, so that it becomes possible to prevent the idle running of the page turning roller 22 and to lift the page 96 over such roller. In addition, the present invention is also constructed such that in case the page 96 can not be partially turned up due to the reduced flexural rigidity of the passbook 82, or the page 96 cannot be kept in its partially turned up state due to a deformed or curved passbook, the retrying routine is utilized. In this routine the passbook 82 is moved closer to the page turning roller 22, or the turning amount of the page 96 is increased, resulting in an increase in the resilient force of the passbook 82 and of the page 96 against bending, all in an arrangement wherein the partial turning up of the page and the maintaining of the page in such state are performed for successful completion of the page turning operation.

It is thus seen that herein shown and described is a page turning apparatus and method for use with passbooks wherein the passbook is advanced a distance to ensure contact with a page turning roller and to re-execute the page turning operation in case the page is not partially turned up or is not maintained in the turned up condition. The method and apparatus provide for alternate operations of retrying routines in case of folded or curved passbooks or where the page of the passbook has reduced resilience to bending. The page turning mechanism of the present invention enables the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A page turning apparatus comprising means for driving a multiple-page document along a feed path to a page turning station, means positioned adjacent the feed path and supported for movement in a direction for engaging and moving a page of the document positioned at the turning station to a bowed condition when actuated, means for actuating said engaging and moving means, page turning means positioned adjacent the turning station for engaging the page and moving the page to a partially turned position, and means driving the document a further distance along the feed path for enabling the page turning means to move the page to a fully turned position.

2. The apparatus of claim 1 including means for sensing the bowed condition of the page at the page turning station.

3. The apparatus of claim 1 including guide means positioned adjacent the page turning station and movable along the feed path to permit advancement of the document for engagement by the page turning means to move the page to the bowed condition.

4. The apparatus of claim 1 including means for detecting the position of the document being advanced by the driving means along the feed path.

5. The apparatus of claim 1 including sequence controlling means responsive to the position of the document relative to the page turning station and to the bowed condition of the page.

6. The apparatus of claim 1 including pressure means opposed to said driving means for gripping said document as said document advances past said page turning station.

7. The apparatus of claim 1 including retry controlling means for operating the page turning means at least a second time to ensure moving of the page to a partially turned position.

8. The apparatus of claim 1 wherein said means for driving comprises a plurality of drive rollers and opposed driven rollers spaced along the feed path of the document on either side of the page turning station.

9. The apparatus of claim 1 wherein the engaging and moving means comprises a plate member positioned at the page turning station and movable in a direction normal to the path of the document.

10. The apparatus of claim 1 wherein the page turning means comprises a roller positioned adjacent the page turning station and responsive to the means for driving the documents a further distance along the feed path.

11. A page turning apparatus comprising means forming a guide chute for supporting a multipage document along a feed path, first roller means adjacent the guide chute for driving the document along the feed path to a page turning station, pressing means positioned adjacent the guide chute and supported for movement in a direction for engaging and moving a page of the document positioned at the page turning station to a bowed condition when actuated, means for actuating said pressing means, second roller means positioned adjacent said guide chute for engaging the page and moving the page to a partially turned position, means for rotating said second roller means for moving the page to the partially turned position, and means for driving the document a further distance along the feed path for enabling the second roller means to move the page to a fully turned position.

12. The apparatus of claim 11 including means adjacent the first and second roller means for sensing the bowed condition of the page at the page turning station.

13. The apparatus of claim 11 including means for detecting the position of the documents being advanced by the first roller means along the feed path.

14. The apparatus of claim 11 including sequence controlling means responsive to the position of the document relative to the page turning station and to the bowed condition of the page.

15. The apparatus of claim 11 including at least one pressure roller opposed to said first roller means for gripping said document as said document advances past said page turning station.

16. The apparatus of claim 11 including retry control means for operating the page turning means at least a second time to ensure moving of the page to a partially turned position.

17. The apparatus of claim 11 wherein the pressing means comprises a plate member positioned at the page turning station and movable in a direction normal to the path of the document.

18. The apparatus of claim 14 wherein the sequence control means comprises detecting means responsive to the position of the document relative to the page turning station and means for advancing the document closer to the second roller means dependent upon the condition of the document page.

* * * * *